US006722771B1

(12) United States Patent
Stephens

(10) Patent No.: US 6,722,771 B1
(45) Date of Patent: Apr. 20, 2004

(54) HAND HELD TRAFFIC CONTROL LIGHT

(76) Inventor: Eugene Stephens, 16159 Oxley, Apt. 202, Southfield, MI (US) 48075

( * ) Notice: Subject to any disclaimer, the term of this patent is extended or adjusted under 35 U.S.C. 154(b) by 0 days.

(21) Appl. No.: 09/573,757

(22) Filed: May 18, 2000

Related U.S. Application Data

(60) Provisional application No. 60/134,753, filed on May 18, 1999.

(51) Int. Cl.[7] ..... F21L 4/02

(52) U.S. Cl. ..... 362/184; 362/185; 362/800; 362/251; 362/230; 362/231; 362/114; 362/113

(58) Field of Search ..... 362/184, 185, 362/206, 800, 251, 230, 231, 276, 802, 205, 102, 109, 114, 113, 197; 340/321, 331, 815.45, 815.66, 815.67

(56) References Cited

U.S. PATENT DOCUMENTS 1,946,059 A * 2/1934 Buchholz ..... 340/321
3,001,185 A * 9/1961 Cleek ..... 315/313
5,097,399 A * 3/1992 Gammache ..... 362/197
5,374,876 A * 12/1994 Horibata et al. ..... 315/313
5,580,156 A * 12/1996 Suzuki et al. ..... 362/184
5,697,695 A * 12/1997 Lin et al. ..... 362/184
6,067,013 A * 5/2000 Pejic ..... 340/321

* cited by examiner

*Primary Examiner*—Sandra O'Shea
*Assistant Examiner*—Bertrand Zeade
(74) *Attorney, Agent, or Firm*—John R. Benefiel

(57) ABSTRACT

A hand held light for traffic control using an array of light sources such as colored light LEDs or lasers which either a red set or green set are energized by operation of a trigger switch. A third set of yellow light emitting light sources are also optionally operated, as well as a spot light mounted within the array of light sources. A position switch prevents energizing the red or green light sources so that arm motion can also be used to control the light sources.

8 Claims, 4 Drawing Sheets

HAND HELD TRAFFIC CONTROL LIGHT

CROSS REFERENCE TO RELATED APPLICATION

This application claims benefit of provisional patent application U.S. Ser. No. 60/134,753, filed May 18, 1999.

BACKGROUND OF THE INVENTION

This invention concerns hand held light signaling devices, and more particularly hand held lights used to control traffic, as when a police officer must control traffic at an intersection where a signal light has become disabled.

Hand held lighted batons or flashlights and the like have been devised, but these prior designs have not provided sufficient signaling capability for effective traffic control. Most have required incandescent lamps, limiting the life of the supply batteries. None have been failsafe and very convenient and effectively controlled in use.

It is the object of the present invention to provide a hand held light which may provide manual traffic signaling, which is convenient and easy to use effectively, while not having high power requirements to allow a long battery life.

SUMMARY OF THE INVENTION

This object, and others which will become apparent upon a reading of the following specification and claims are achieved by a hand held light having a circular array formed by sets of solid state light sources, such as LEDs or low powered lasers, respective sets of the light sources emitting red or green light, either the red or green light sources energized depending on the state of a trigger switch operated by the finger of a person gripping an elongated handle with the right or left hand.

A set of yellow light sources also may be provided, energized by the trigger switch when a power switch is in the off state.

The light also has a white light emitting lamp which can be energized by a separate switch for enabling use of a flashlight. When the trigger switch is not squeezed, power circuitry establishes a normal red light source on condition which causes the set of red LEDs or other sources to flash, to indicate to traffic at which the light is directed should remain stopped. With the trigger switch squeezed, the set of green light emitting light sources are energized.

Both red and green light activation require a position switch to be in its closed position, produced only when the light is held upright, so that the red and green light sources can also be turned on and off with the arm position of the holder, improving the case and effectiveness of use.

Indicator lights at the back of the light to enable a user to see what light is on may be included, as well as, and charging circuitry for the batteries.

A detachable visor is also optionally provided, snap fit to a smaller night visor built in to the head portion of the light housing.

DETAILED DESCRIPTION

Figure 1:
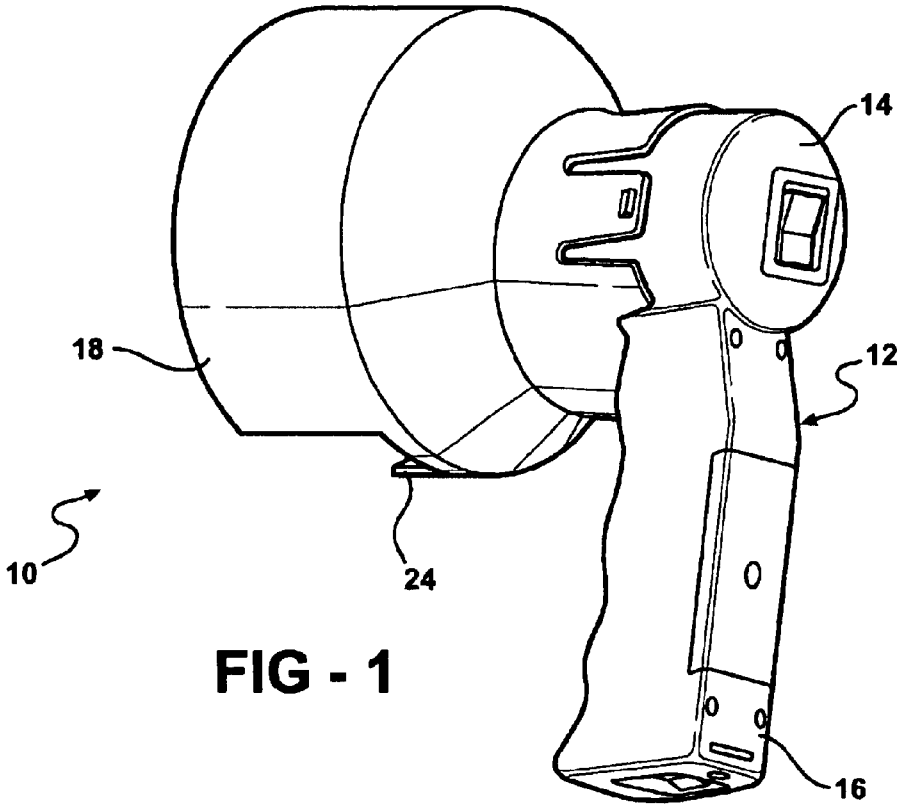
FIG. 1 is a rear perspective view of the hand held signal light according to the present invention with a day visor attached.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the hand held traffic control light 10 according to the present invention includes a housing 12 having a generally cylindrical head portion 14 and an elongated handle portion 16, the head portion turned at a right angle to the handle portion 16, so as to be able to easily point a front face of the head portion 14 forwardly when the handle portion 16 is gripped.

Figure 4:
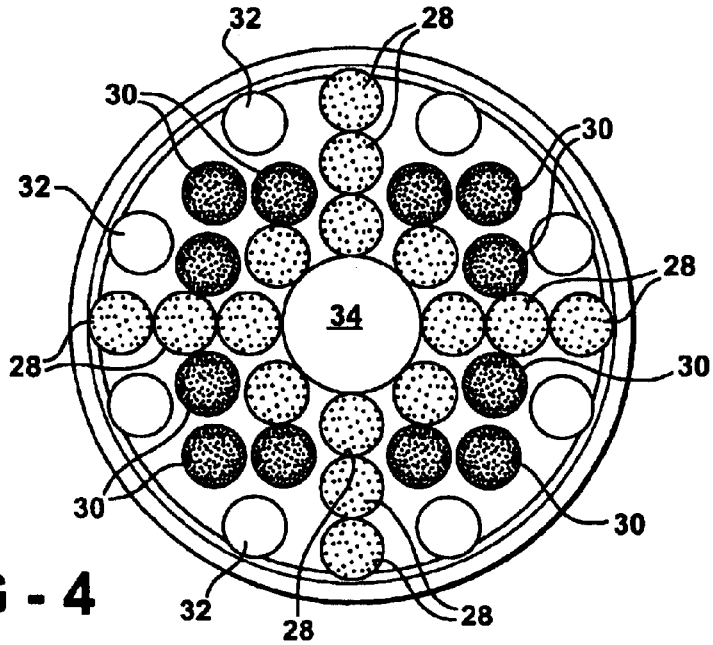
FIG. 4 is a front view of the light head portion showing the light source pattern.
Figure 2:
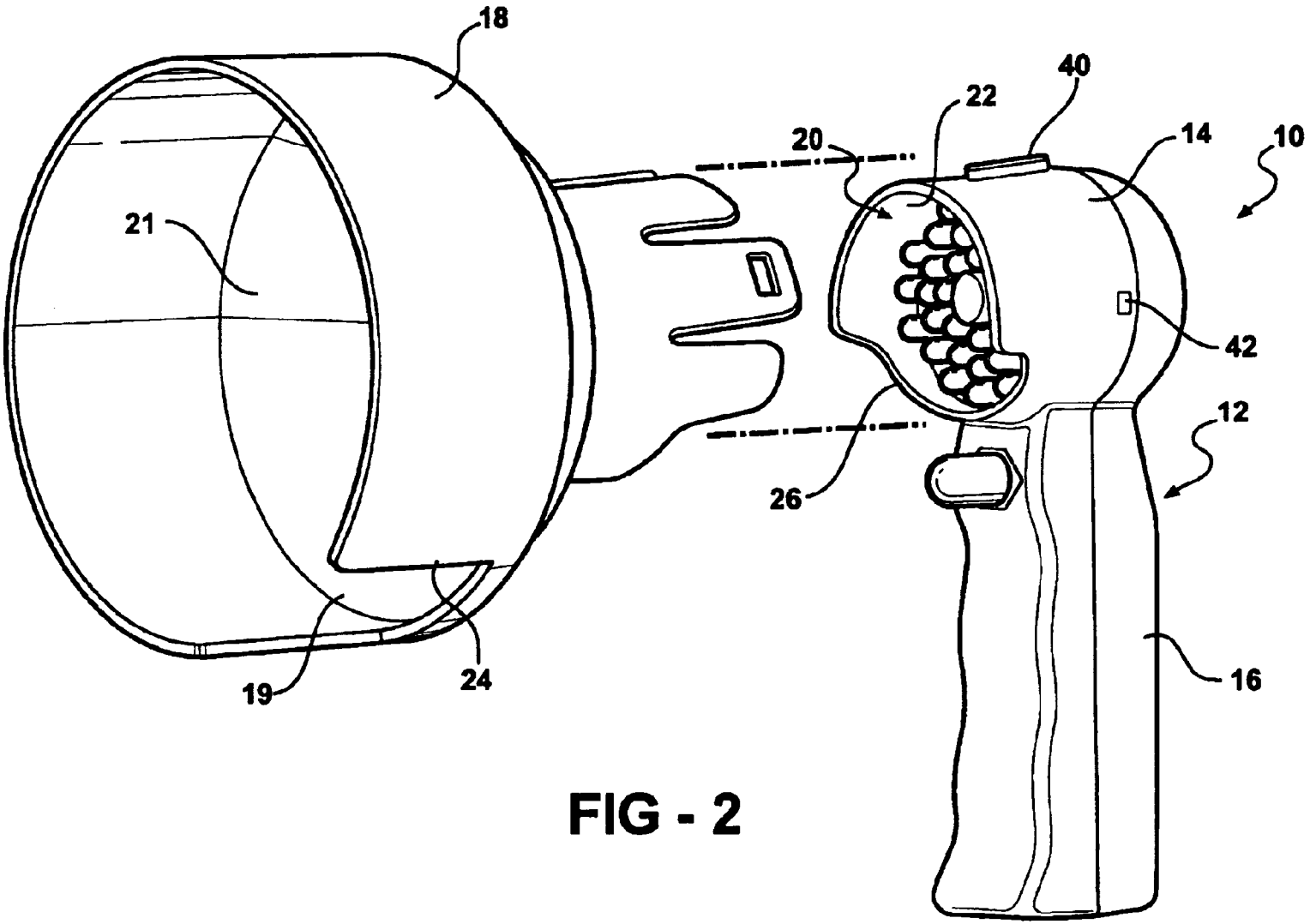
FIG. 2 is a front perspective view of the light shown in FIG. 1, with the day visor shown detached and separated from the light.
Figure 3:
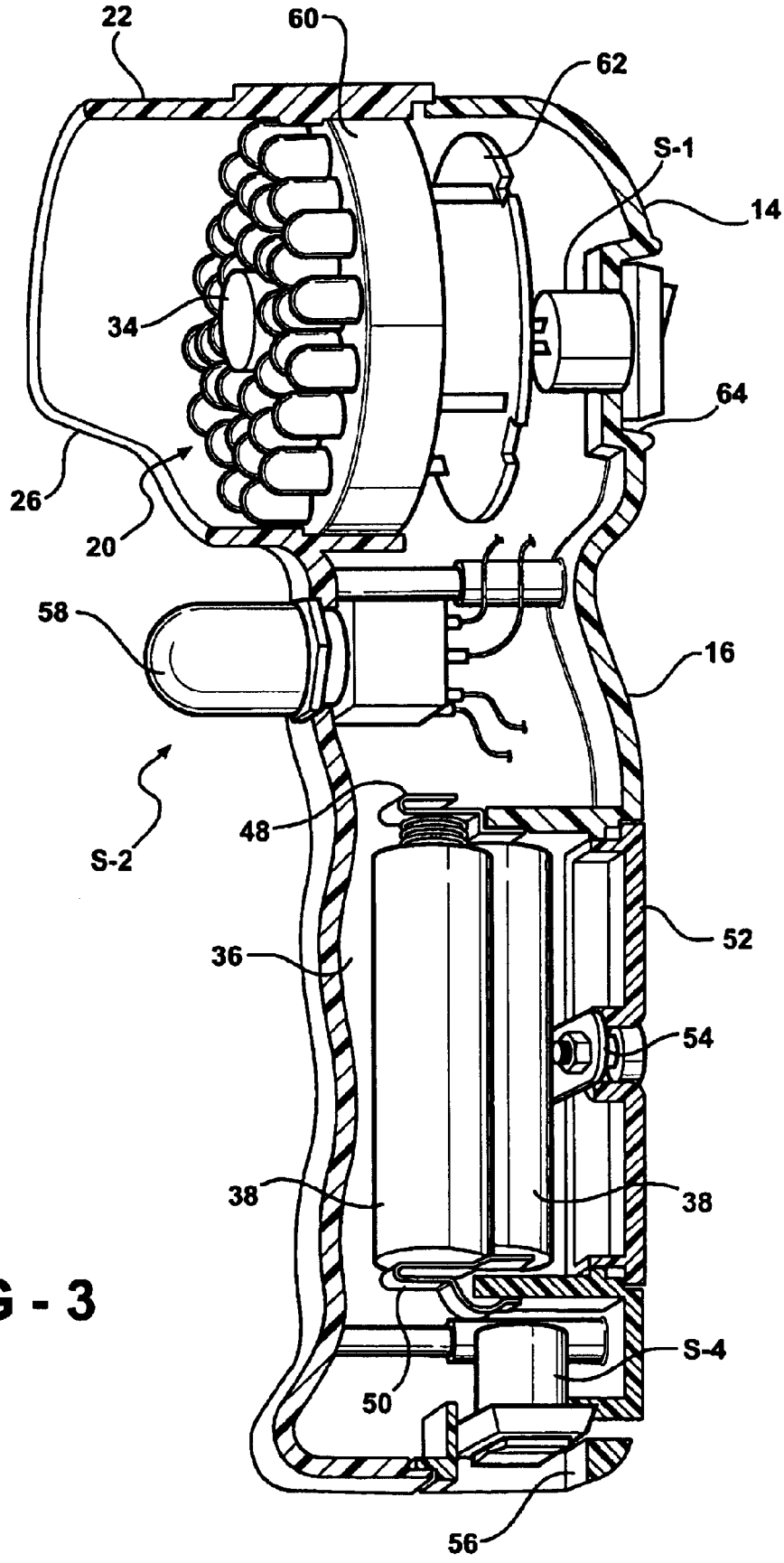
FIG. 3 is a partially sectional enlarged view taken lengthwise through the light housing, revealing the major internal components.

A daytime visor 18 is shown snap fitted to the built in much smaller night time visor 22 of the head portion 14 in FIG. 1 and detached and separated in FIG. 2, which shields and directs the light emanating from a circular array 20 of solid state light sources (FIG. 4) facing forwardly on the front side of the head portion 14.

The head portion 14 built in night time visor 22 acts to shield the light to some extent and improve its directionality.

The day time visor 18 has a bottom cut out 214 and the built in visor 22 also has a cut out 26 to allow ambient reflected light to be directed down and away from the light sources. The day visor 18 may have a reflector 19 and clear (or black tinted) lens 21. Projections 40, 42 cooperate with slots 44, 46 to hold the day visor 18 on the night visor 22.

The housing 12 may be constructed as a two piece injection molded construction in the well known manner.

The circular array 20 of colored solid state light sources (such as LED's or lasers) include a pattern of 16 red colored light sources 28, 12 green colored light sources 30, and eight yellow colored light sources 32.

A single incandescent lamp 34 is mounted at the center of the colored light source array 20 for incidental use of the light 10 as a flashlight.

The handle portion 16 of housing 12 has a battery compartment 36 receiving a pair of lithium batteries 38 held between battery terminal clips 48, 50.

A cover 52 is held with a screw held tab 54.

A bottom located rocker switch S-4 is accessible through an opening 56 in the bottom of the handle portion 16.

A trigger switch S-2 has a protruding rubber booted operator pin 58 facing forwardly at the upper part of the handle portion 16 pushable with the encircling index finger of the hand of the user gripping the handle portion 16. The switch S-2 is DPDT momentary switch.

The head portion 14 houses a light source base 60 a PC board 62, and a power stand by rocker switch S-1, operable through an opening 64 at the rear of the head portion 14.

Figure 5:
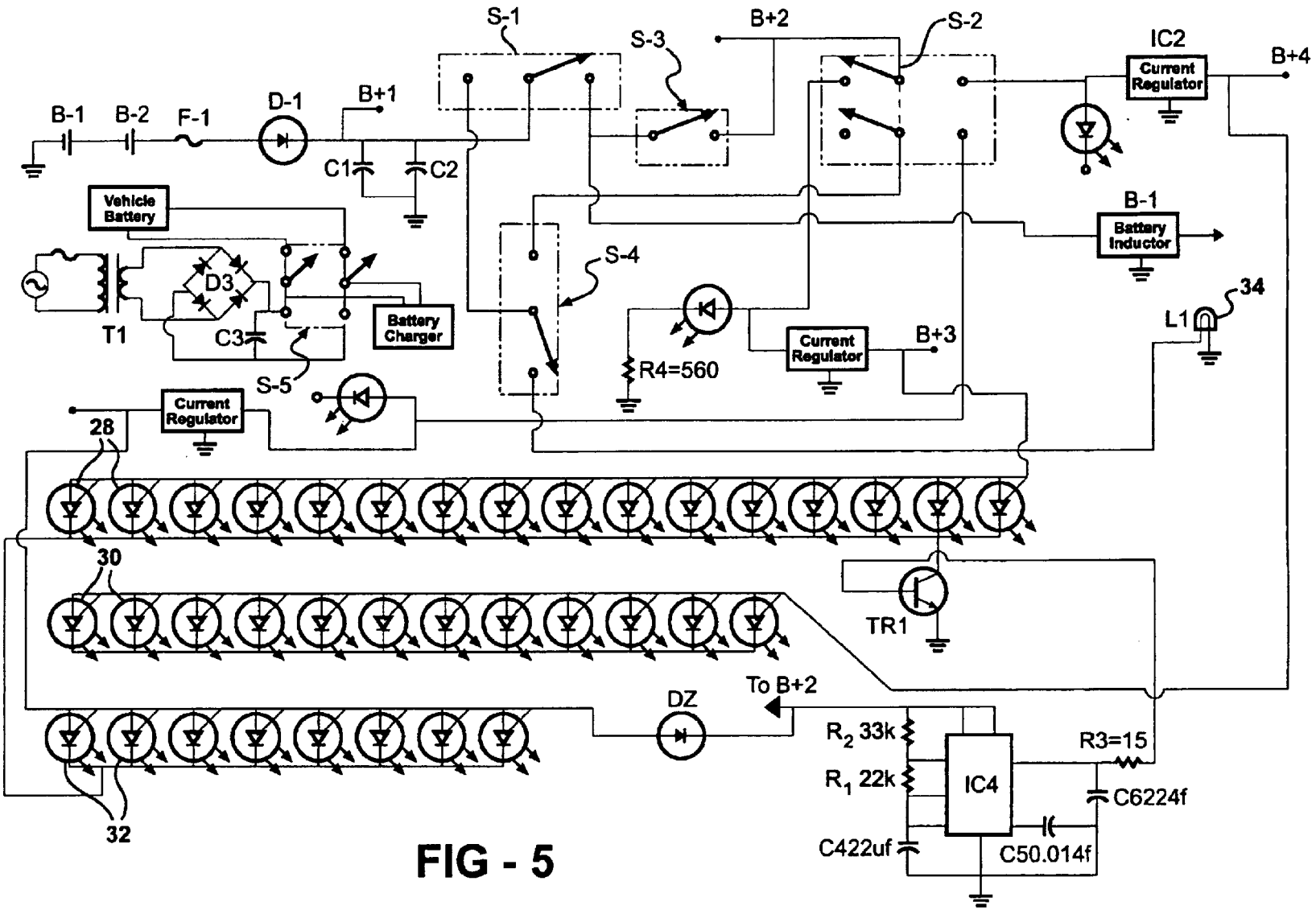
FIG. 5 is a schematic diagram of the electrical components included in the light according to the invention.

The remaining electrical components shown in FIG. 5 are carried on the PC board 62.

B1 and B2 are 1.5 vdc lithium batteries 38 that are connected in series to provide 3 vdc supply voltage to power the light 10. F1 provides over-current protection for the electronic components. D1 protects the circuit from reverse polarity due to incorrect battery insertion. C1 is a decoupling capacitor that minimizes unwanted oscillations. C2 provides regulation and filtering of the supply voltage.

B+1 supplies power to power switch S1 and S1 supplies power to S3, S4, B+2, S2, BI−1 and L1. B+2 supplies power to IC4. B+3 supplies power to the red LEDs. B+4 supplies power to the Green LEDs. B+5 supplies power to the yellow LEDs. S-3 is a position sensitive switch on the PC board 62.

S1 is a single-pole, double-throw rocker switch with a built in tri-color LED. S1 is located in the rear of the head portion 14. S1 has two positions, power stand-by and power off. In the power off mode S1 supplies power to S4. When S4 is in the spotlight (white light) on position and S1 is in the power off position, spotlight L1 is activated. The position of the light 10 does not affect the power supplied to L1.

When S1 is in the power standby mode, power is applied to S3 and the battery indicator circuit BI−1. S3 is a single-pole single-throw, position sensitive switch. Trigger switch S2 is a momentary double-pole double-throw switch. The trigger switch S-2 is used to activate the green or yellow LEDs 30, 32.

When S2 is in the normally closed position it applies power to the red LEDs. When S2 is depressed power is applied to the green LEDs and associated circuits. S1 must be in the power standby mode before the green LEDs will operate. Depressing S2 will apply power to the yellow LEDs and associated circuits, provided S4 is in the yellow light position and S1 is in the power off position. When the light 10 is held in a vertical-up position, power is applied to B+2 and S2.

When S1 is in the power standby mode and the HHTCL is held in the vertical-down position, red and green lights are off. Raising the light to the vertical-up position causes the red LEDs to flash on and off. The first automatic command when one raises the light up is stop. The first command will be a green light if S2 trigger switch is squeezed (activated) and held while raising the light 10 to a vertical-up position.

The red and green LEDs will not operate unless: 1. S1 power switch is in the power standby mode; 2. S3 position switch is in the vertical-up position. S2 trigger switch is in normally closed position (not depressed)=red LEDs on. S2 trigger switch in depressed position=green LEDs on.

The yellow LEDs and white spotlight will not operate unless S1 power switch is in the off position; S4 spot light switch is in the on position=L1 spot light on; S4 spotlight switch in the off position=yellow LEDs on; and S2 trigger switch is in the depressed position=yellow LEDs on. Note: B+C=yellow LEDs on.

IC1 regulates the current to the red LEDs. IC2 regulates the current tot he green LEDs. IC3 regulates the current to the yellow LEDs.

TR1 is a NPN bipolar transistor that supplies ground potential for the red and yellow LEDs. The duty cycle of TR1 is controlled by IC4.

IC4 is a 555 timer configured to supply a positive pulse to the base of TR1. The values of R1, R2 or C4 can be changed to alter the flash rate. The square wave astable configuration was selected because the timing network is not driven from the output. Loading at pin 3 will have no effect on timing. Pin 3 may be loaded on a relatively unrestricted basis. C6 increases stabilization at output of IC4. R3 is a current limiting resistor for the base circuit of TR1.

D2 provides isolation between B+2 and B+5. D2 provides power to IC4 during the flashing yellow light operation.

LED37 is a tri-color LED producing red or yellow or green light. LED 37 comprises an indicator allowing the operator to look at the rear of the head portion 14 and see which color light is active. The LED37 is located at the rear of the head assembly. LED39 is a tri-color LED that indicates the condition of the battery. LED39 is built in S4 and located at the bottom of the handle of the housing 12.

The batteries 38 can be charged from the vehicle 12 vdc accessory power or 110 vac. TI is step-down transformer that applies ac voltage the full wave bridge rectifier D3. The electrolytic capacitor C3 provides filtering for the power supply. S5 is a double-pole double-throw switch on the charger that allows battery charging from the vehicle or office. BCHG1 is an integrated battery charger. F2 provides over current protection for the battery charging circuit. Battery indicator IC5 monitors the power level in the batteries and displays through tri-color LED38.

The light source for the head assembly may be high output LEDs or lasers. LEDs are less expensive than lasers. O-LEDs (organic film LEDs) may be used.

The hand held light 10 is used for short-term traffic control. The primary function of the light 10 is to move street traffic safely and expeditiously through or around an incident. An incident is an emergency traffic accident, natural disaster or special event.

The light 10 is used to control traffic through a temporary traffic control area. The light 10 will allow a user to give drivers more positive guidance than a flashlight with cone, white gloves with hand signals or a whistle. The following instructions are for a person directing traffic at an intersection where an incident has occurred.

The person directing traffic is positioned in the center of the intersection with the light 10 pointed down. The S-1 switch on the rear of the head position 14 is switched to the power stand by position. A glance down at the handle reveals a battery condition light, green=battery o.k., yellow=weak battery, and red=replace or recharge batteries. The battery condition LED is located in the bottom of the handle. The bottom of the handle 16 is visible when the light 10 is pointed down.

Raising the light 10 will automatically activate the flashing red LEDs by operation of switch S-3. Depressing and holding the trigger switch located at front of the handle before raising the light will activate the green LEDs. The green light will stay on as long as the trigger switch is depressed. The green LEDs produce a stable green light, they do not flash on or off.

To stop traffic, the operation should use the traditional hand-signaling procedure for stopping oncoming traffic at an incident. The operation should face traffic and extend the left arm horizontally away from the body with the palm toward approaching traffic. While the left arm is extended, the right hand raises the light 10 with the right arm extended away from the body and the light 10 pointed at oncoming traffic. The light 10 will then produce a bright flashing red light to stop oncoming traffic.

To advance traffic the operation should lower the light 10 and turn to face the stopped traffic that is waiting to be advanced. The operator should squeeze the light trigger switch S-2 while raising and extending the right arm to point the light at stopped traffic. The light 10 produces a steady green light. The free hand is used to motion for traffic to proceed. Note: A left-handed operator may choose to hold the light 10 in the left hand.

To alert or slow traffic the operator should make sure that the power switch S-1 at the rear of the head portion 14 is in the off position. The operator should extend the right arm to point the light 10 at approaching traffic and squeeze the light trigger switch S-2 to activate the yellow light. The free hand is used to motion for traffic to proceed with caution. The yellow light cannot be activated unless the power switch S-1 is in the off position.

The switch S-4 to turn the spotlight on is located at the bottom of the handle portion 16. The spotlight 34 produces a bright white light. The spotlight cannot be operated unless the power switch S-1 is in the off position. The spotlight should not replace existing spotlights or flashlights but provide a convenient incidental or emergency light while at the area.

A tri-color LED37 is located at the rear of the head assembly. The LED37 indicates to the operator which color light is active at the front of the head portion 14 by displaying the same color light at the rear of the head assembly.

The sun visor 18 should be used when the sunlight impairs the visibility of the light produced by the light. The visor 18 snaps over the night visor 22 of the light 10. The visor is black in color and has an opening at the bottom to eliminate sunlight being reflected onto the lens of the light.

The battery charger will recharge the batteries 34 from the office, home or vehicle with complete automatic operation. Two battery clips will be supplied to allow recharging of one while the other one is being used. The rechargeable batteries are located in the handle 16 of the light 10. The battery clip must be removed from the light 10 before recharging.

The LEDs 28, 30, 32 may be two chip dual ultra bright LEDs. There are two chips that produce light inside a single 5 mm (T1-¾) case. The LEDs have three leads, left side anode, right side anode and a common cathode. The typical forward current is 20 ma but it produces twice the light output of a single chip LED. The advantage is twice the light output with the same current consumption as a single chip LED.

The light 10 uses 36 ultra bright LEDs. The 36 ultra bright LEDs have 72 chips, which is equivalent to 72 single chip LEDs. If 72 single chip LEDs were used the light head assembly would be 4 inches in diameter instead of 2 inches in diameter. A light with a 4 inch head assembly would not be portable enough for police officers and traffic control personnel.

What is claimed is:

1. A hand held light for use in traffic control comprising:

a housing having an elongated handle portion grippable by a user and a head portion at one end of said handle portion extending transversely to said handle portion;

an array of light sources formed by a plurality of individual light sources all arranged facing a front side of said head portion, a first set of said light sources emitting red light when energized and a second set of said light sources emitting green colored light when energized, a hood surrounding said front side of said head portion to direct light from said light sources to the front of said head portion;

a power supply for selectively energizing either said red or green light emitting light sources; and a trigger switch mounted to said handle portion to be sgueezably operated by a finger of an operator gripping the handle, said trigger switch when squeezed causing only one of said red or green light emitting light sources to be selectively energized by said power supply, and when released causing the other of said red or green light sources to be energized by said power supply and said one of said red or green light emitting sources to be deenergized, whereby only a red or a green light source is selectively energized by squeezing of said trigger switch.

2. The hand held light according to claim 1 wherein said light sources are solid state elements.

3. The hand held light according to claim 2 wherein said light sources are LEDs.

4. The hand held light according to claim 1 further including a third set of light sources emitting yellow light when energized, and a power switch when turned off preventing energizing said red or green light sources when said trigger switch is squeezed but rather causing said power supply to energize said third set of light sources when said trigger switch is squeezed.

5. The hand held light according to claim 1 further including a position sensitive switch preventing energizing either said red or green light sources by said trigger switch unless said light is held upright with said head portion extending substantially horizontally.

6. The hand held light according to claim 1 wherein said red and green light sources are arranged in a circular array and further including a white spot light lamp centered in said circular array of light sources and a switch selectively operable to energize said spot light by said power supply only when said red or green light sources are not able to be energized due to operation of a power switch included in said hand held light.

7. The hand held light according to claim 5 wherein said power circuit causes energization of said red light emitting light sources when said light is moved to an upright position and said trigger switch is not operated.

8. The hand held light according to claim 5 wherein said power circuit causes only said red light emitting light sources to be energized whenever a power switch is activated and said light is held in an upright position unless said trigger switch is squeezed, which squeezing of said trigger switch causes only said green light emitting light sources to be energized, but only if said light is held in said upright position.

* * * * *